US007059050B2

(12) United States Patent
Calhoun et al.

(10) Patent No.: US 7,059,050 B2
(45) Date of Patent: Jun. 13, 2006

(54) ONE PIECE INTEGRAL REINFORCEMENT WITH ANGLED END CAPS TO FACILITATE ASSEMBLY TO CORE

(75) Inventors: Chris A. Calhoun, Niagara Falls, NY (US); Terry Joseph Hunt, Williamsville, NY (US); David A. Southwick, Lockport, NY (US); Karl Paul Kroetsch, Williamsville, NY (US); Krzysztof Wawrocki, Ostrow Wlkp. (PL); Khalid El Moutamid, Vivier Au Court (FR); Yusuke Matsunaga, Amherst, NY (US); Laurent Art, Ethe (BE)

(73) Assignee: Delphi Technologies, Inc., Troy, MI (US)

( * ) Notice: Subject to any disclaimer, the term of this patent is extended or adjusted under 35 U.S.C. 154(b) by 210 days.

(21) Appl. No.: 10/753,692

(22) Filed: Jan. 8, 2004

(65) Prior Publication Data

US 2005/0150641 A1 Jul. 14, 2005

(51) Int. Cl.
*B21D 53/02* (2006.01)
*F28F 9/02* (2006.01)

(52) U.S. Cl. ..... 29/890.052; 165/149

(58) Field of Classification Search ..... 29/890.03, 29/890.052
See application file for complete search history.

(56) References Cited

U.S. PATENT DOCUMENTS

| | | | | |
|---|---|---|---|---|
| 5,236,042 | A | 8/1993 | Kado | 163/149 |
| 5,678,628 | A | 10/1997 | Aki et al. | 165/173 |
| 6,012,512 | A * | 1/2000 | Ghiani | 165/140 |
| 6,267,174 | B1 | 7/2001 | Ozaki et al. | 165/140 |
| 6,293,334 | B1 * | 9/2001 | Ghiani | 165/149 |
| 6,311,768 | B1 * | 11/2001 | Jamison et al. | 165/173 |
| 6,640,886 | B1 * | 11/2003 | Lamich | 165/174 |
| 6,705,387 | B1 * | 3/2004 | Kokubunji et al. | 165/67 |
| 2002/0023735 | A1 * | 2/2002 | Uchikawa et al. | 165/81 |
| 2002/0029872 | A1 * | 3/2002 | Jamison et al. | 165/153 |
| 2002/0056541 | A1 | 5/2002 | Kokubunji et al. | 165/67 |
| 2002/0084064 | A1 * | 7/2002 | Rhodes et al. | 165/149 |
| 2004/0069468 | A1 * | 4/2004 | Lamich et al. | 165/148 |
| 2005/0092461 | A1 * | 5/2005 | Kroetsch et al. | 165/67 |
| 2005/0109492 | A1 * | 5/2005 | Kroetsch et al. | 165/149 |

FOREIGN PATENT DOCUMENTS

| | | | |
|---|---|---|---|
| DE | 10132153 | A1 * | 1/2003 |
| EP | 1 030 157 | A1 | 8/2000 |
| EP | 1 088 689 | A2 | 4/2001 |
| EP | 1391676 | A2 * | 2/2004 |

* cited by examiner

*Primary Examiner*—Allen J. Flanigan
(74) *Attorney, Agent, or Firm*—Patrick M. Griffin

(57) ABSTRACT

A metal tank cap is integral with a reinforcing member via a narrow connection and is flared outwardly at the narrow connection portion to be over an open end of the tank simultaneously with moving the metal tubes of the core into the tank. By unbending the connection portion, the respective tank caps are deflared into the open ends of the respective tanks and the entire assembly is placed in a furnace and brazed together.

6 Claims, 2 Drawing Sheets

ONE PIECE INTEGRAL REINFORCEMENT WITH ANGLED END CAPS TO FACILITATE ASSEMBLY TO CORE

BACKGROUND OF THE INVENTION

1. Field of the Invention

The subject invention relates to a heat exchanger assembly of the type having a tank at each end of a core with the tanks having open ends that are closed by caps.

2. Description of the Related Art

Such prior art assemblies fabricate independent caps for closing the ends of the tanks thereby requiring separate and independent fabrication of caps as well as separate handling and assembly of the caps to the tanks. The independent caps may be connected to the side reinforcing members but such a process requires four independent caps and two reinforcement members. There are assemblies wherein the caps are extrusions of the reinforcement members.

BRIEF SUMMARY OF THE INVENTION AND ADVANTAGES

The invention provides a method of fabricating a heat exchanger assembly having a core with fins and tubes extending from opposite ends and into openings in tanks at each end of the core and reinforcement members extending along opposite sides of the core with tank caps closing open ends of the tanks. The invention improves the method by forming at least one of the reinforcement members integrally with a tank cap at a connection portion. The tank cap is flared outwardly at the connection portion from parallel relationship to the integral reinforcement member and is passed over the open end of the tank as the tubes of the core are inserted into the openings in the tank.

Accordingly, the metal components may be pre-assembled and inserted into a furnace where they are brazed together instead of being mechanically connected together as by crimping at the joint between the core and the tanks as is the case with radiators that have a metal core and plastic tanks and gasket seals. which results in a protrusion from the side of the assemblies. Therefore, the invention provides a heat exchanger assembly having a narrower profile with the attendant advantages of a totally brazed assembly.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
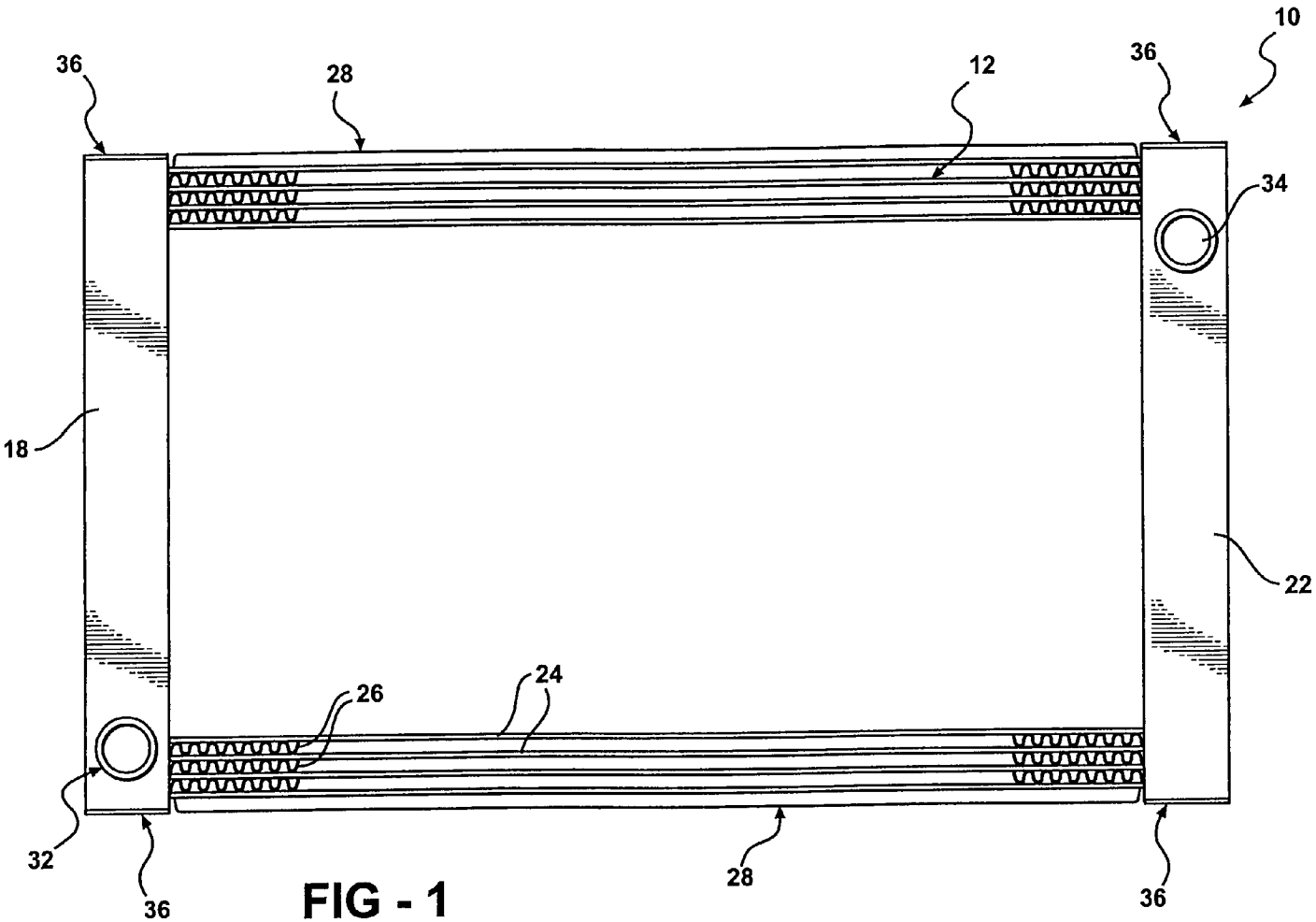
FIG. 1 is an elevational view of an heat exchanger constructed in accordance with the subject invention.

Referring to the Figures, wherein like numerals indicate like or corresponding parts throughout the several views, a heat exchanger assembly constructed in accordance with the subject invention is generally shown at 10 in FIG. 1.

The heat exchanger assembly 10 includes a heat exchanger core 12 for exchanging heat with a fluid flowing between the ends thereof. A first tank 18 is disposed at a first end of the core 12 and a second tank 22 is disposed at the second end of the core 12 for fluid flow through the heat exchanger core 12 between the tanks 18 and 22. The core 12 includes tubes 24 with heat exchanger fins 26 extending between the tubes 24, the tubes 24 extending from opposite ends between opposite sides thereof, as is well known in the art. The ends of the tubes 24 are inserted into openings or slots in the respective tanks 18 and 22 for fluid flow between the tanks. In other words, the first 18 and second 22 tanks are disposed at the opposite ends of the core 12 and are in fluid tight communication with the tubes 24. In addition, the tanks 18 and 22 extending between open ends, one of which is shown at 30 in FIG. 2. In addition, as is customary in the art, reinforcing members, generally shown at 28, extend along the opposite sides of the core 12. The tanks 18 and 22 also include nozzles or pipes 32 and 34 to act as an inlet and an outlet to convey fluid into and out of the tanks 18 and 22.

The heat exchanger assembly 10 includes a plurality of tank caps 36 closing the open ends 30 of the tanks 18, 22. However, in accordance with the subject invention, the reinforcing members 28 and the adjacent tank cap 36 are one integral member. More specifically, each reinforcing member 28 and two of the integral tank caps 36 at the respective opposite ends consist of one homogenous material, namely a metal such as aluminum. A tank cap 36 is integral with each end of each reinforcing member 28 via a homogenous s-shaped connector 37 having reverse bends 39 and 41 for closing the opposite open ends 30 of both tanks 18 and 22 at opposite ends of the core 12. The connectors 37 may also contain a feature such as notches 43, to further facilitate the bending and provide a thermal stress relief area and are of a smaller or more narrow width than either the integral tank cap 36 or the integral reinforcement member 28 to facilitate bending. The reinforcing members 28, the tank caps 36, and the tubes 24 consist of metal and are brazed or otherwise welded together.

Figure 3:
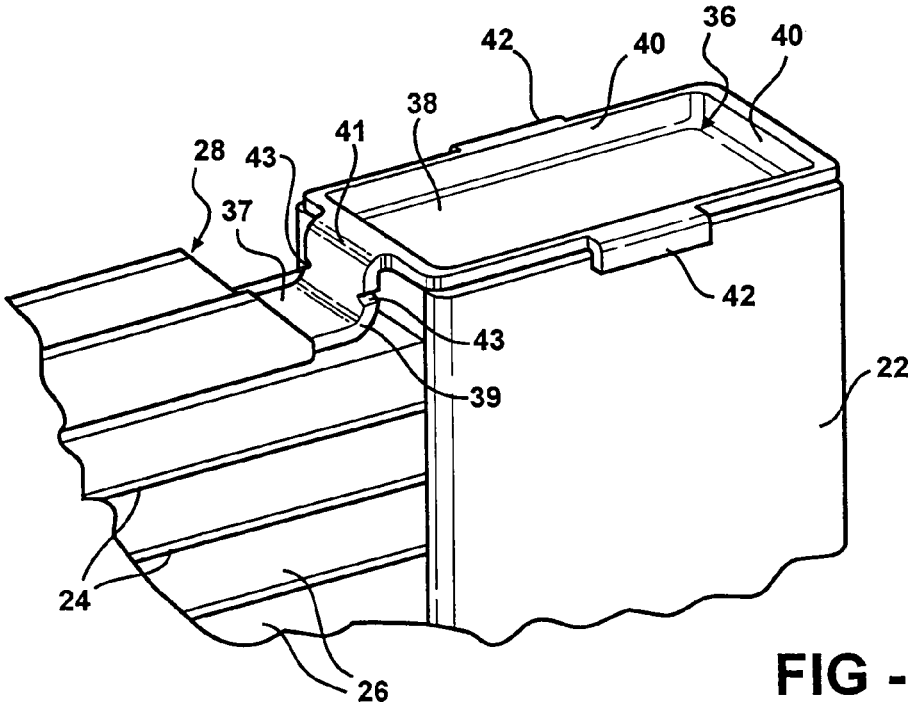
FIG. 3 is a view like FIG. 2, but showing the tank cap engaging the tank.

As illustrated in FIG. 3, each tank cap 36 is disposed in mechanical interlocking engagement with the open end of the tank 18 or 22. More specifically, each tank cap 36 has a dished configuration with a bottom 38 and sidewalls 40 engaging the interior of the open end 30 of each tank 18 or 22. A plurality of tabs 42 extend from the periphery of the sidewalls 40 of the tank cap 36 and engage the open end 30 of the tank 18 or 22. The tabs 42 are crimped into mechanical interlocking engagement with the exterior of the tank 18 or 22.

Figure 2:
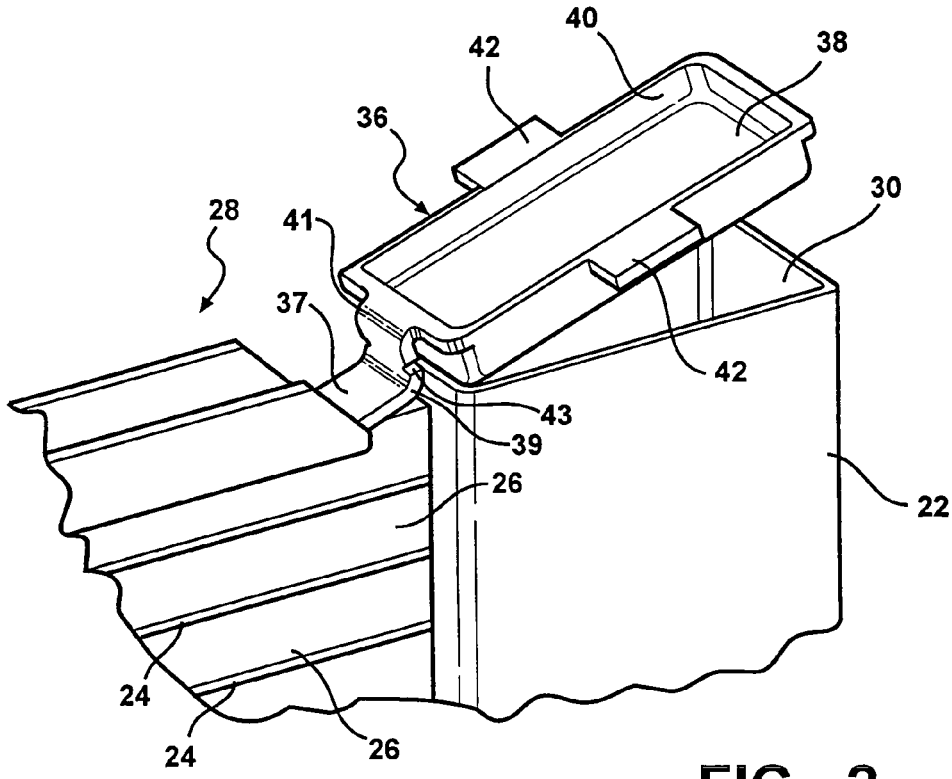
FIG. 2 is a fragmentary perspective view showing the fabrication of the core to the tank.

As will be appreciated, the invention provides a method of fabricating a heat exchanger assembly 10 having a core 12 with fins and tubes extending from opposite ends and into openings or slots in tanks 18 or 22 at each end of the core 12 and reinforcement members 28 extending along opposite sides of the core 12 with tank caps 36 closing open ends 30 of the tanks 18 or 22, wherein the reinforcement members 28 are formed integrally with a tank cap 36 at each end by connection portions 37. The method proceeds by moving the metal tank cap 36 over the open end 30 in one end of the metal tank 18 or 22 simultaneously with moving the metal tubes 24 of the core 12 into the openings in the tank 18 or 22. This is facilitated by flaring the tank cap 36 outwardly from a parallel or aligned position with the plane of the integral reinforcement member 28 for passing the tank cap 36 over the open end 30 of the tank 18 or 22 as the tubes 24 of the tank 18 or 22 are simultaneously inserted into the openings in the tank 18 or 22. As illustrated in FIG. 2 the tank cap 36 is flared outwardly from the reinforcement member 28 by bending the connection portion 37 about twenty degrees (20°), although the angle may vary in a range, e.g., five to twenty degrees (5° and 20°) relative to the plane of the integral reinforcement member 28. As will be appreciated, the tank caps 36 at both ends are flared for passing the tank caps 36 over the open ends 30 of the tanks 18 and 22 at opposite ends of the core 12, whereupon the respective tank caps 36 are deflared into the open ends 30 of the respective tanks 18 and 22 by re-bending the connection portions 37.

After the core 12 has been assembled to the tank 18 and 22, the method continues by deflaring, i.e., re-bending the connectors 37, the tank caps 36 at each end of the reinforcement members 28 into the open ends 30 of the tanks 18 and 22, as illustrated in FIG. 3. In order to facilitate the closure of the open ends 30 of the tanks 18 and 22, the tank cap 36 are formed with a dished configuration having a bottom 38 for disposition in the open end 30 of the tank 18 and 22 and side walls 40 for engaging the interior of the tank 18 and 22 for being brazed thereto. The method is further defined as forming a plurality of tabs 42 extending from the periphery of the tank caps 36 for engaging the end of each tank 18 or 22 whereby the tank caps 36 are secured in place by crimping the tabs 42 into engagement with the exterior of each tank 18 and 22 for holding each tank cap 36 in engagement with the tank 18 or 22. The crimped engagement holds each tank cap 36 into engagement with the tank 18 or 22 for brazing. The clinch tabs 42 may not be required if the fit between the end caps 36 and the associated tank is snug enough. Once all of the components are assembled together, the final step involves placing the assembled components in a furnace brazing the metal components together.

Obviously, many modifications and variations of the present invention are possible in light of the above teachings. The invention may be practiced otherwise than as specifically described within the scope of the appended claims.

What is claimed is:

1. A method of fabricating a heat exchanger assembly having a core with fins and tubes extending from opposite ends and into openings in tanks at each end of the core and reinforcement members extending along opposite sides of the core with tank caps closing open ends of the tanks, said method comprising the steps of;

forming a tank cap with a dished configuration having a bottom for disposition in the open end of the tank and side walls for engaging the interior of the tank for brazing thereto, forming at least one of the reinforcement members integrally with a tank cap via an S-shaped connection portion more narrow in width than the tank cap integral therewith, forming the connection portion with at least one notch therein for defining a bending area, flaring the tank cap outwardly at the connection portion from parallel relationship to the integral reinforcement member, passing the tank cap over the open end of the tank as the tubes of the core are inserted into the openings in the tank, and deflaring the tank cap into the open end of the tank with a side wall thereof engaging the interior of the tank under said connection portion.

2. A method as set forth in claim 1 including fabricating the reinforcement members, the tank cap and the tank components of metal and brazing the metal components together.

3. A method as set forth in claim 1 including forming the reinforcing member with an integral tank cap at each end.

4. A method as set forth in claim 1 including flaring the tank caps at both ends for passing the tank caps over the open ends of the tanks at opposite ends of the core; and deflaring the respective tank caps into the open ends of the respective tanks.

5. A method as set forth in claim 4 further defined as forming a plurality of tabs extending from the periphery of the tank caps for engaging the end of the tank.

6. A method as set forth in claim 5 including crimping the tabs into engagement with the exterior of the tank for holding the tank cap in engagement with the tank.

* * * * *